US006457210B1

(12) United States Patent
Shirai et al.

(10) Patent No.: US 6,457,210 B1
(45) Date of Patent: Oct. 1, 2002

(54) BUCKLE AND BAND WITH THIS BUCKLE

(75) Inventors: Syoji Shirai; Kouhei Musha, both of Tokyo (JP)

(73) Assignee: Builmatel Co., Ltd., Tokyo (JP)

( * ) Notice: Subject to any disclaimer, the term of this patent is extended or adjusted under 35 U.S.C. 154(b) by 0 days.

(21) Appl. No.: 09/673,382

(22) PCT Filed: Apr. 15, 1999

(86) PCT No.: PCT/JP99/02010

§ 371 (c)(1),
(2), (4) Date: Oct. 16, 2000

(87) PCT Pub. No.: WO99/53792

PCT Pub. Date: Oct. 28, 1999

(30) Foreign Application Priority Data

| | | |
|---|---|---|
| Apr. 23, 1998 | (JP) | 10-112607 |
| Aug. 10, 1998 | (JP) | 10-225799 |
| Aug. 28, 1998 | (JP) | 10-242713 |
| Dec. 25, 1998 | (JP) | 10-370310 |

(51) Int. Cl.[7] ..... A44B 21/00; A42B 1/22
(52) U.S. Cl. ..... 24/16 PB
(58) Field of Search ..... 24/16 PB, 17 AP, 24/30.5 P; 2/416–421; 248/74.3

(56) References Cited

U.S. PATENT DOCUMENTS

| | | | | | |
|---|---|---|---|---|---|
| 2,325,841 | A | * | 8/1943 | Faber | 294/31.2 |
| 2,979,794 | A | * | 7/1961 | De Bartolo | 24/17 R |
| 3,098,271 | A | * | 7/1963 | Caveney | 24/16 R |
| 3,855,669 | A | * | 12/1974 | Meyer | 24/16 PB |
| 4,162,553 | A | * | 7/1979 | Bruno | 15/167.1 |
| 4,708,306 | A | * | 11/1987 | Mitomi | 24/16 PB X |
| 4,727,630 | A | * | 3/1988 | Alan | 24/585 |
| 4,733,440 | A | * | 3/1988 | Ogawa | 24/170 |
| 4,951,362 | A | * | 8/1990 | Denemark et al. | 24/16 PB |
| 4,999,846 | A | * | 3/1991 | Ball et al. | 2/5 |
| 5,267,967 | A | * | 12/1993 | Schneider | 24/16 PB X |
| 5,296,669 | A | * | 3/1994 | Sampson | 24/16 PB |
| 5,479,797 | A | * | 1/1996 | Peterson | 24/16 PB X |
| 5,685,048 | A | * | 11/1997 | Benoit | 24/16 PB |
| 5,687,455 | A | * | 11/1997 | Alexander | 24/16 PB |
| 5,774,953 | A | * | 7/1998 | Mao | 24/585 |
| 5,896,586 | A | * | 4/1999 | Freund | 2/418 |
| 5,898,586 | A | * | 4/1999 | Freund | 2/418 |
| 6,003,208 | A | * | 12/1999 | Christian et al. | 24/16 PB |
| 6,076,234 | A | * | 6/2000 | Khokhar et al. | 24/16 PB |
| 6,314,587 | B1 | * | 11/2001 | Fang | 2/418 |
| 6,332,227 | B1 | * | 12/2001 | Fang | 2/418 |
| 6,341,382 | B1 | * | 2/2002 | Ryvin et al. | 2/417 |

FOREIGN PATENT DOCUMENTS

| | | |
|---|---|---|
| JP | 61-111303 | 7/1986 |
| JP | 1-72108 | 5/1989 |
| JP | 4-40807 | 4/1992 |

* cited by examiner

*Primary Examiner*—Robert J. Sandy
*Assistant Examiner*—Ruth C Rodriguez
(74) *Attorney, Agent, or Firm*—Kanesaka & Takeuchi

(57) ABSTRACT

A band has an engaging projection part at one end, and an engaging grooves at the other end to adjust the connection in an annular shape. The band is movable forward but not movable backward relative to the other under the condition that the engaging projection part is locked to the engaging recessed part. A pair of hook parts capable of pulling both end parts by fingers of one hand is installed on both end parts. A buckle connected to the band includes a buckle main body having a bottom plate, a roof frame, and side plates for connecting the bottom plate to the roof frame. An operating plate is installed horizontally inside the roof frame, and has an engaging claw engageable with the band engaging grooves and a pressing part. The buckle and the band is made simple, and easily attached together.

7 Claims, 10 Drawing Sheets

Fig.16 Prior Art

BUCKLE AND BAND WITH THIS BUCKLE

FIELD OF THE INVENTION

The present invention relates to structure of a band (or a belt) having a buckle at its joint edge section, and more specifically relates to a band used as a head band for a helmet, a watch band, a band for trousers or a skirt, or a band for shoes or a bag.

The present invention also relates to a buckle for locking a band having an engagement groove, and more specifically to a buckle for a band or a belt such as a head band for a helmet, a watch band, a band for trousers or a skirt, or a band for shoes or a bag.

BACKGROUND TECHNOLOGY

A head band for a helmet is set around a head of a wearer and plays a role for locking the helmet to the head.

FIG. 3 shows an ordinary helmet 1 for working, and is a perspective view in section showing a cap body 2, an internal setting body 4 penetrating a liner 3 adhered thereto for absorbing shock. The setting body 4 comprises a cross-like hammock 5, a head band 10 connected in a circular form, and a jaw strap 6, and this setting body 4 is set via brackets 7, 7 to the cap 2 to form the helmet 1.

It is necessary to adjust a peripheral length of the head band 10 for adjusting the size to the size of the wearer's head. In this example based on the conventional technology, a number of small projections 8, 8 . . . are provided at an even space in one edge section of the head band 10, while small holes engaging with the small projections 8, 8 . . . respectively are provided in the longitudinal direction of the head band 10, and the peripheral length can be adjusted by engaging the projections in the small holes appropriately.

As the sizes of the small projections and small holes are small, it is not easy to set or remove the headband 10, and the work for adjusting the head band 10 in the rear section of the head is extremely difficult when the helmet 1 is set on the wearer's head.

On the other hand, when it is required to adjust a peripheral length of a head band, a size-adjustable band employing the pinion rack system therein (Refer to Japanese Patent Laid-Open Publication No. HEI 8-27613), or a head band for a helmet in which a worm screw mechanism is incorporated on the head band for enabling fine adjustment (Refer to Japanese Patent Laid-Open Publication No. HEI 7-293515) is available.

The head band adjustment mechanism shave, however, the defect that, as the construction becomes more complicated, the weight of the helmet disadvantageously increases.

When any of a watch, an arm ring, a portable information terminal such as a personal computer, a tonometer, trousers, or a skirt is worn around wearer's arm, leg, or trunk, the peripheral length is adjusted with the band in loading on or off. It is not easy, however, to loading on or off the band with a single hand, and especially it is extremely difficult to adjust the band in the rear section of the wearer's head which is hardly visible, during night, or at a dark place.

In a case of a watch band, sometimes an intermediate catch is provided in the middle of the watch band so that the wearer can set the band or remove it with one hand by operating the catch with claws of finger tips. However, the work for loading on or off a watch with the intermediate catch is difficult for a person with short claws or a person with a weak power, and improvement of the intermediate catch will result in complication of its mechanism and structure.

Further there has been known a buckle with an engagement groove, in which a buckle hook is resiliently hooked. In this type of buckle, the wearer can disengage the hooking at will.

FIG. 16 is a perspective view showing a representative buckle of this type. A buckle body 51 comprises a bottom plate 52 and side plates 53, 53 and has a substantially ⊐-shaped cross section. Shaft 54 is spanned over the side plates 53, 53 with a cover piece 55 attached to the shaft 54. An edge 55A of the cover piece 55 is biased by a coil spring 56 to the bottom plate 52, and the other edge 55B of the cover piece 55 is used as a section for pressing. Further the buckle has a hole 57 or the like, which is used for attaching the buckle to a basic body of a bag, shoes, or various types of bands. On the other hand, in a band used as a pair with the buckle, engagement grooves each having a cross section like saw teeth and extending in the longitudinal direction are provided side by side, and the band is inserted into a space formed between the buckle body 51 and the cover piece 55.

With the buckle structure as described above, when the band is passed through the space, the band pushes the cover piece 55 upward against a springing force of the coil spring 56, and when insertion of the band is stopped at a desired fastening position, an edge 55A of the cover piece 55 hooks in the engagement groove of the band, and movement of the band in the pulling-off direction is limited. When pulling off the band, the other edge 55B of the cover piece 55 is pushed down to the buckle body 51, and with this operation the edge 55A is raised from the engagement groove of the band, thus the band being disengaged from the buckle.

The conventional type of buckles have many components, so that the work for assembling the buckle is time-consuming and complicated, and in addition the buckles are metallic, so that the weight is heavy. Therefore such types of buckles can not satisfy the current demands for weight reduction. In addition, as the mechanism for releasing the engagement between the buckle and the band by pressing from upside of the buckle body to the bottom plate is employed, and because of this structural feature, sometimes the band may be disengaged from the buckle due to unexpected contact of the buckle to something.

DISCLOSURE OF THE INVENTION

It is an object of the present invention to provide a buckle and a band with this buckle based on a simple structure which can easily be loaded on or off.

In one embodiment, the band according to the present invention has a protruding section for engagement at its one edge section and a recessed section also for engagement at the other edge section thereof, and is connected into a circular form by engaging the two sections for engagement and sliding the two edge sections to adjust its peripheral length. When the protruding section for engagement is hooked in the recessed section for engagement, the other edge section can freely move forward against the one edge section, but can not move backward, and a pair of hooking sections, with which the wearer can pull up the two edge sections with fingers of a hand, is provided at the two edge sections on a top surface of the band.

In another embodiment, the band according to the present invention has a groove for engagement at its one edge section and a claw for engagement at the other edge section, and is set into a circular form by engaging the engagement groove with the engagement claw and sliding the two edge sections of the band for adjusting the peripheral length. A resilient piece having the engagement claw is provided in parallel to the other edge section, and when the engagement claw is hooked in the engagement groove, the one edge section can freely move forward against the other edge section, but can not move backward. However, the engagement can be disengaged from the engagement groove by operating the resilient piece, and the resilient piece is made from a material harder than the material for the two edge sections of the band.

The buckle made from synthetic resin according to the present invention has a buckle body and an operation plate. The buckle body comprises a bottom plate, a ceiling frame opposite to the bottom plate and two side plates connecting the bottom plate and the ceiling frame to each other, and the buckle body has a space for insertion of a band with an engagement groove. The operation plate is provided inside the ceiling frame in the horizontal position and has an engagement claw for engagement with the engagement groove of the band on a bottom surface of its one edge and a top surface at the other edge used as a pressed section. By jointing the operation plate to opposite two edges of the ceiling frame at a middle point between the engagement claw and the pressed section, the operation plate can freely be swung at the middle point as a fulcrum.

BRIEF DESCRIPTION OF THE DRAWINGS

FIG. 1(*c*) is a longitudinal side view showing the cross section in the state where the engagement is released;

FIG. 16 is a perspective view showing an example of a buckle based on the conventional technology.

BEST MODE FOR CARRYING OUT THE INVENTION

Figure 1A:
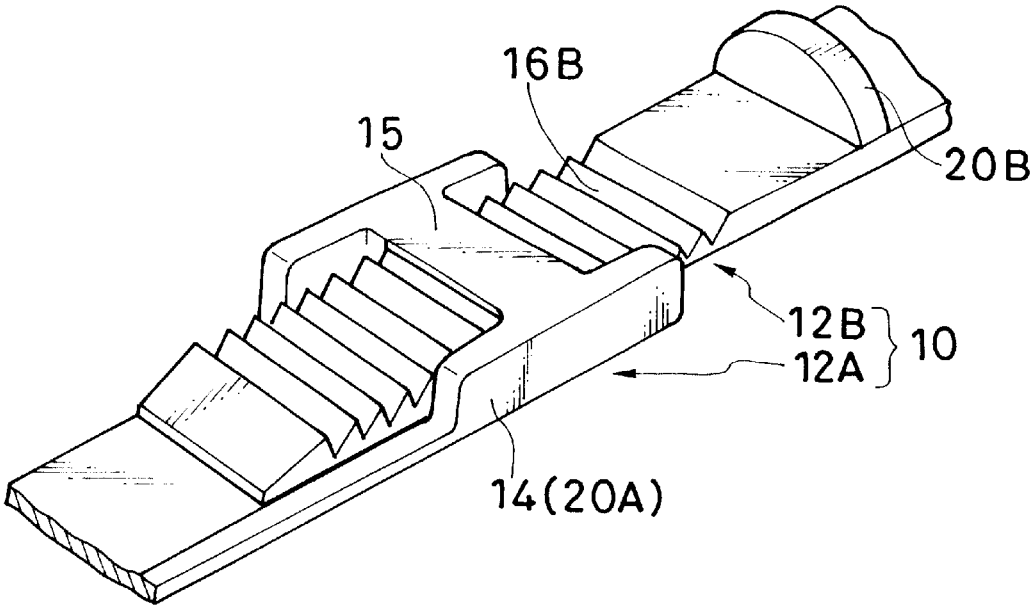
FIG. 1(*a*) is a perspective view showing a state in which two edge sections of the band according to the present invention are engaged with each other, while FIG. 1(*b*) is a longitudinal side view showing the cross section thereof cut in the peripheral direction.

The best mode for carrying out the invention is described below with reference to a head band as the best example thereof shown in the drawings.

Figure 1B:
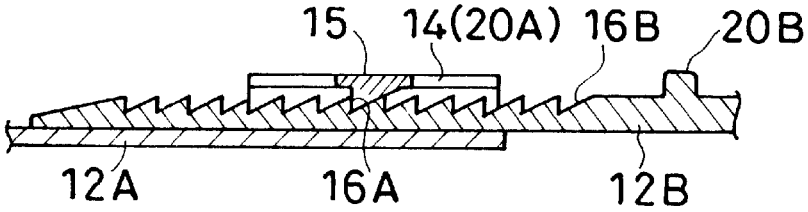
Figure 1C:
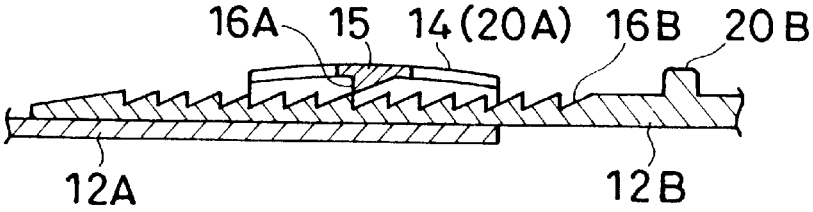

FIG. 1(*a*) is a perspective view showing a state where two edge sections of a head band 10 are engaged with each other, while FIG. 1(*b*) is a longitudinal side view showing the same in the peripheral direction. For convenience in description, an edge section having a protruding section for engagement is described as one edge section 12A, and a section with a recessed section for engagement is described as the other edge section 12B.

A slide guide 14 having a looped portion is provided in the one edge section 12A which makes the other edge section 12B possible to insert easily therein or to prevent, and a claw-shaped protruding engagement section 16A is formed inside a stop ring 15 of the slide guide 14 as shown in FIG. 1(*b*).

On the other hand, a recessed engagement section 16B having a sawtoothed cross section is provided on a top surface of the other edge section 12B. With the configuration, the two engagement sections 16A, 16B are engaged with each other by sliding the two edge sections 12A, 12B, and the head band 10 is set to a circular form by adjusting the length thereof to that appropriate for the wearer. When the claw-formed engagement protruding section 16A is hooked in the recessed engagement section 16B having a sawtoothed cross section, the other edge section 12B can freely move forward against the one edge section 12A, but can not move backward.

Figure 2A:
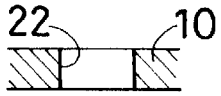
FIGS. 2(*a*)–2(*c*) are cross-sectional views showing an edge section of the head band.
Figure 2B:
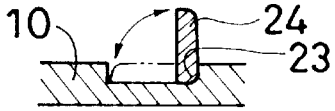
Figure 2C:
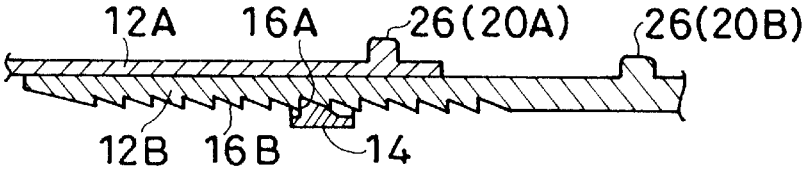
Figure 3:
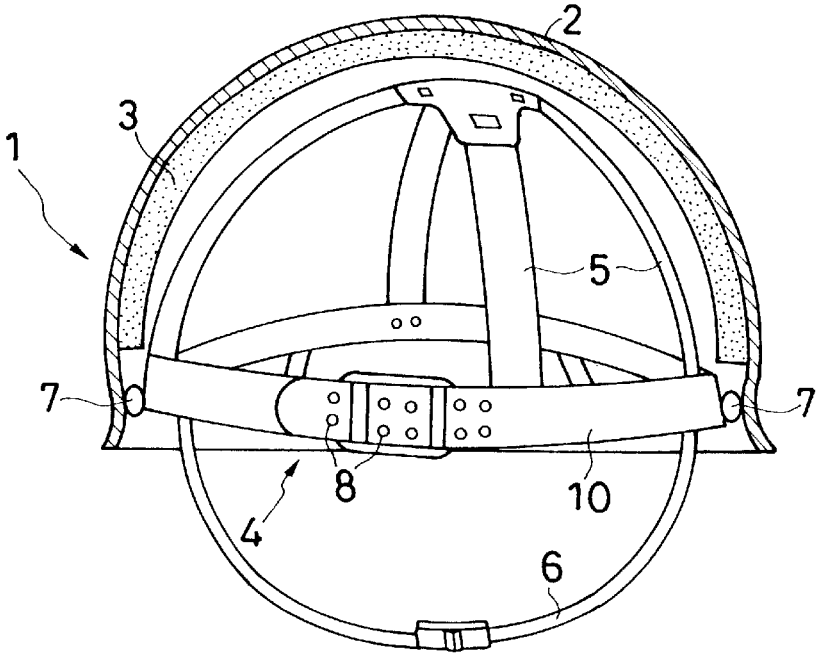
FIG. 3 is a longitudinal side view showing inside of a general helmet for works.

At the other edge section 12B, a hooking section 20B is provided in the protruding form at the back of the recessed engagement section 16B on a top surface thereof. The hooking section 20B is required only to have a size and a form enough to be gripped by finger tips. Therefore, in addition to the semi-cylindrical form shown in the figure, the hooking section may have a cylindrical or a rectangular column form. Further a through-hole 22 penetrating from an outer surface to an inner surface of the head band 10 as shown in FIG. 2(*a*) may be provided, or a hinge 24 supported by a pin 23 as a fulcrum as shown in FIG. 2(*b*) may be used. protruding slightly from an outer surface of the one edge section 12A is provided at the one edge section 12A, so that the slide guide 14 can be used as a hooking section 20A for the one edge section 12A. In this invention, however, the slide guide 14 is not always required, and for the head band 10 not having a portion like the hooking section 20A for the slide guide 14, an independent hooking section 20A may be provided also at the one edge section 12A.

Even in a case where the slide guide 14 is provided at the one edge section 12A as shown in FIG. 2(*c*), a projection 26 as the hooking section 20A may be provided at the one edge section 12A.

It is to be noted that the head band 10 is fabricated with such materials as polyvinyl chloride, polyethylene, other flexible synthetic resins, or hard rubber. In this step, it is preferable to previously form a curved surface matching a periphery of the wearer's head on the head band 10.

The head band 10 according to this embodiment has the configuration as described above, so that, by hooking finger tips of a hand in the stop ring 15 as the hooking section 20A and the hooking section 20B, and by pulling them closer to each other, the other edge section 12B goes into the slide guide 14 with the engagement sections 16A and 16B rubbing each other, thus a peripheral length of the head band 10 being adjusted to the required length.

In this state, even if the other edge section 12B is pulled away from the one edge section 12A, the other edge section 12B does not move because the two engagement sections 16A and 16B are engaged with each other.

When the engagement between the two engagement sections 16A and 16B is released and the other edge section 12B is pulled off from the one edge section 12A, it is required only to press side sections of the slide guide 14 (especially at the position of the stop ring 15) from the outside with fingers, and bend the stop ring 15 to the outer side (to the upper side in FIG. 1(*a*) and FIG. 1(*b*)). With the operation above, engagement between the two engagement sections 16A and 16B are released as shown in FIG. 1(*c*), so that the other edge section 12B moves backward to the one edge section 12A, and the head band 10 being loosened naturally.

There is no specific restriction over a hooking style at the two edge sections of the head band 10. Therefore, in addition to the configuration according to the embodiment as described above, the present invention can be applied to a head band with the other edge section 12B of the head band 10 allowable to move only in one direction to or away from the one edge section 12A when the two engagement sections are engaged with each other by providing the pair of hooking sections 20A, 20B described above thereon.

With the head band according to the present invention, the size can be adjusted only with finger tips of one hand when the head band is set on a wearer's head. Therefore, with this head band, it is possible to quickly, easily, and accurately load on or off the helmet.

Further, as the structure of the head band is quite simple, the production cost is low with weight increase of the helmet suppressed.

A head band according to another embodiment of the present invention is described below. For convenience in the following description, a direction in which each edge section advances when two edge sections of the head band are engaged is described as forward direction, and a direction in which each edge section moves back is described as backward direction.

Figure 4:
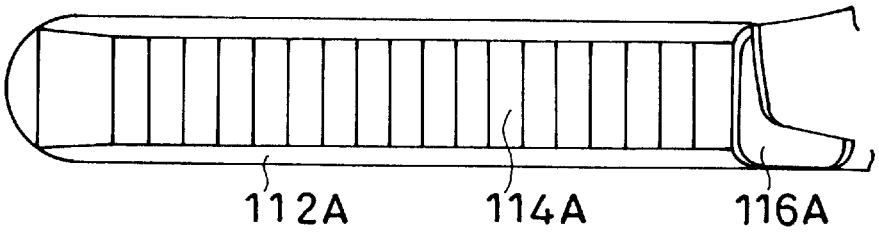
FIGS. 4(*a*) and 4(*b*) are partial front views showing a state in which two edge sections of a head band are separated from each other.
Figure 4:
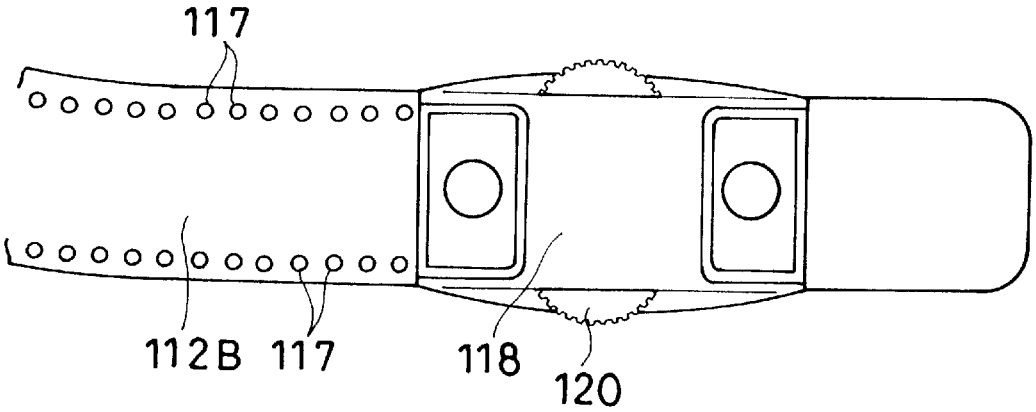
Figure 5:
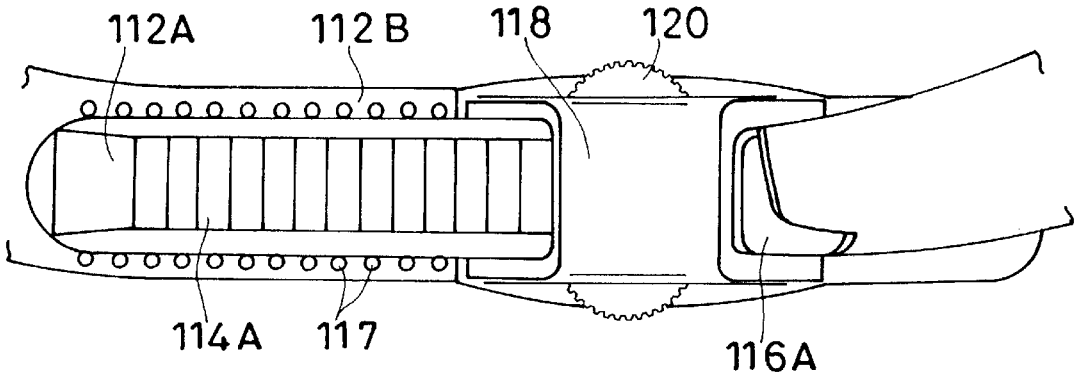
FIG. 5 is a front view showing a state in which the two edge sections of the head band are engaged with each other.

FIGS. 4(*a*) and 4(*b*) are partial front views showing a state in which two edge sections of a head band 110 are separated from each other, and FIG. 5 is a front view showing a state in which the two edge sections of the head band 110 are engaged with each other. In FIGS. 4(*a*) and 4(*b*), engagement grooves 114A having a sawtoothed cross section are formed on an outer surface of one edge section 112A shown in FIG. 4(*a*). Further at the back of the engagement grooves 114A on an outer surface of the one edge section 112A, there is provided a hooking section 116A protruding therefrom and having a hook-like front section. The hooking section 116A is required only to have the size and form allowing hooking of the wearer's finger tips therein. Therefore, in addition to the configuration shown in the figure, the hooking section 116A may have a form of a cylindrical or semi-cylindrical column. Further a through-hole penetrating the head band from its outer surface to its inner surface may be provided.

Figure 6:
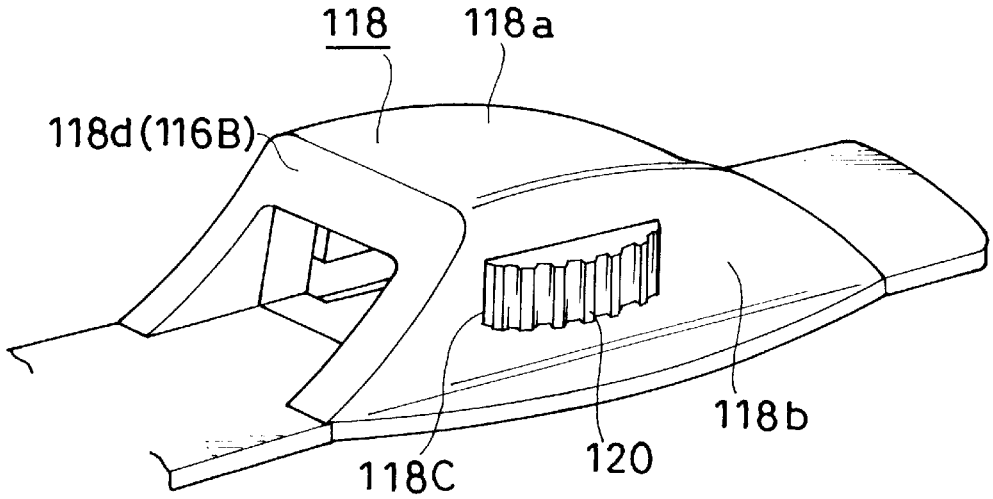
FIG. 6 is a perspective view showing a hood provided at the other edge section of the band.

Provided on the outer surface of the other edge section 112B of the head band shown in FIG. 4(*b*) is a hood 118. The hood 118 has a top wall 118*a* expanding to the outer peripheral side of the head band as shown in FIG. 6, which is the perspective view, and has openings in the front and rear sections, and the one edge section 112A of the head band can be passed through the openings. On a pair of side walls 118*b*, 118*b* constituting the hood 118, there are provided open windows 118*c*, 118*c*, in which a push button 120 described hereinafter can be engaged with a certain degree of allowance.

It is possible to prevent the push button from being pressed carelessly by providing a protrusion not shown in the figure entirely or partially along a periphery of the open window 118*c* on the side walls 118*b*, 118*b*.

In this embodiment, a rear edge section (the left edge section in FIG. 6) 118*d* of the top wall 118*a* is used as a hooking section 116B which is to be provided at the other edge section 112B. However, the hood is not essential in this invention, and therefore in the head band 110 not equipped with the hooking section 116 B like the rear edge section 118*d* of the top wall 118*a*, it is preferable to provide a separated hooking section 116B also at the other edge section 112B.

As shown in FIG. 4(*b*), band holders 117 are provided at the back of the hood 118 on the outer surface of the other edge section 112B along upper and lower rims of the other edge section 112B. It is preferable that each of the band holders 117 comprises a short shaft section and a head section having a diameter larger than that of this shaft section and has the so-called mushroom form. By providing the band holders 117 side by side along the upper rim and lower rim of the other edge section 112B, it is possible to closely press and fit the one edge section 112A of the head band 110 having passed through the hood 118 to the outer surface of the other edge section 112B. The mushroom-shaped band holder 117 is especially advantageous in the point that the one edge section 112A can be held and fixed only by pressing it with a finger tip.

Figure 7:
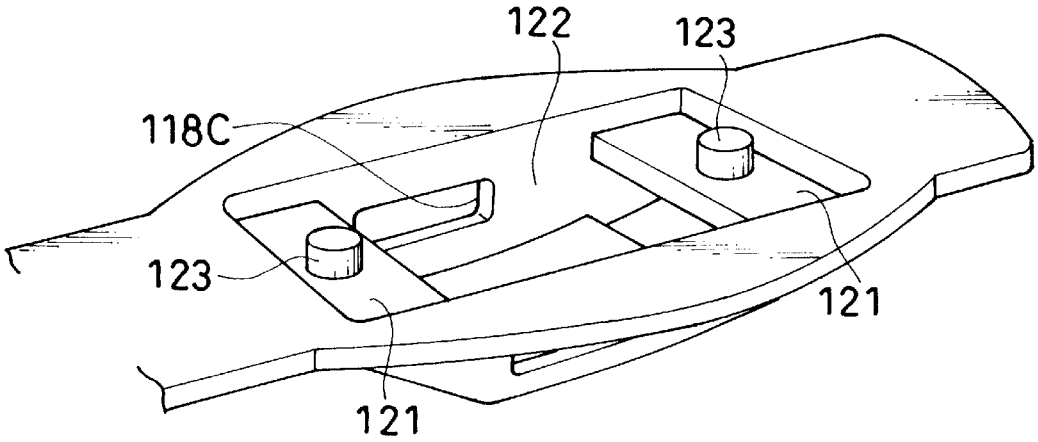
FIG. 7 is a perspective view showing the other edge section viewed from the bottom plate side.

FIG. 7 is a perspective view showing the other edge section 12B seen from the bottom plate side. Inside of the hood 118 is a space 122 in which the engagement section 124 described in detail below is accommodated, and stop pins 123, 123 are provided in the vertical position from the partially raised bottom surface 121 of the band.

Figure 8:
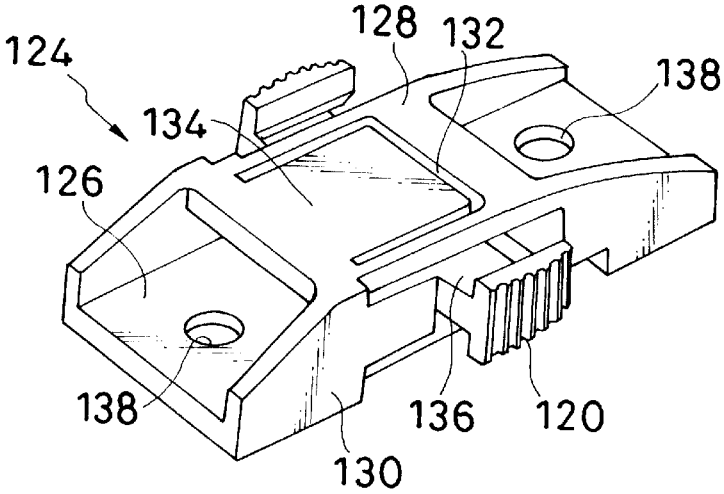
FIG. 8 is a perspective view showing an engagement section accommodated inside the hood.
Figure 9A:
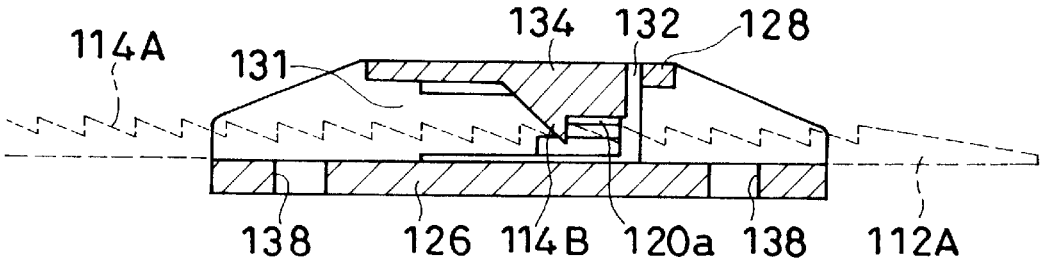
FIGS. 9(*a*) and 9(*b*) are cross-sectional views of the engagement section, and FIG. 9(*a*) shows the engaged state, while FIG. 9(*b*) shows the disengaged state.
Figure 9B:
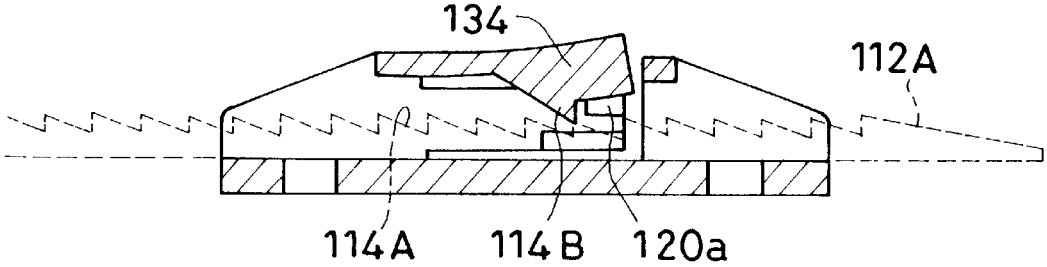

FIG. 8 is a perspective view showing the engagement section 124 accommodated in the space 122 inside the hood 118, and FIG. 9 is a longitudinal side view of the engagement section 124.

The engagement section 124 mainly comprises a bottom wall section 126 and a head wall section 128 opposite to each other and two side wall sections 130, 130 also opposite to each other, and an insertion space 131 into which the one edge section 112A of the head band is inserted is defined by these four wall sections.

A resilient piece 134 is provided on the head wall section 128 by forming a ⊐-shaped slit 132, and an engagement claw 114B is provided in the protruding state on an inner wall of this resilient piece 134 at its head section. In this embodiment, the resilient piece 134 is provided in parallel to the bottom wall section 126, so that the engagement section 124 does not substantially protrude to the outer periphery of the other edge section 112B, which enables the compact structure.

Side pores 136, 136 each communicating to the insertion space 131 are provided on the two side wall sections 130, 130, and push buttons 120, 120 are provided at the extended edges of the two side wall sections 130, 130 at positions opposite to the side pores 136, 136 respectively. The push buttons 120, 120 are elastically deformed inward to the insertion space 131 and contact side sections of the resilient piece 134, thus a tip of the resilient piece 134 being deformed outward from the insertion space 131.

In this embodiment, the push buttons 120 are provided at the extended edge of the side wall section 130, but the push buttons 120 may be provided at any positions on the conditions that the push buttons face the side pores 136, and for instance, a portion of the side wall 118*b* of the hood 118 may be formed with a resilient body so that the portion can function as the push button 120.

The engagement section 124 can be formed into an integrated body by using such synthetic resin as polyacetal, polyoxymethylene, polyamide, polycarbonate. Especially it is necessary to form the resilient body 134 with any synthetic resin so that its free edge side (at which the engagement claw 114B is provided) can swing in the vertical direction. In contrast, as the head band 110 including the two edge sections 112A and 112B directly contact the wearer's head, it is desirable to fabricate it with such soft and flexible synthetic resin as polyvinyl chloride, polyethylene and polypropylene, or with hard rubber.

Therefore in the head band according to the present invention, the resilient piece 134 is made with a material relatively harder as compared to a material used for forming the two edge sections 112A and 112B of the head band.

Alternatively, a synthetic resin material suited to each portion may be employed by forming the head band including the two edge sections 112A, 112B and the engagement section 124 including the resilient piece 134 as independent bodies respectively.

The engagement section 124 is accommodated in the space 122 within the hood 118 and integrated with the other edge section 112B by engaging round holes 138, 138 provided at two sections on the bottom wall section 126 with the stop pins 123, 123.

The head band 110 according to the present invention is set to a circular form by sliding the two edge sections 112A, 112B to hook the engagement claw 114B in the engagement groove 114A for adjusting the length of the head band 110 to that suited to the wearer. Thus, as the head band 110 according to the present invention has the configuration as described above, when the wearer aligns the one edge section 112A with insertion holes on the hood 118 and pulls closer to each other the hooking section 116A of the one edge section 112A and a rear edge section 118*d* of the hood 118 as the hooking section 116B for the other edge section 112B with finger tips of a hand, the engagement groove 114A contacts the engagement claw 114B of the resilient piece 134, and the one edge section 112A advances raising the resilient piece 134, thus a peripheral length of the head band 110 being adjusted to the appropriate length.

In this state, as the engagement claw 114B is hooked in and engaged with the engagement groove 114A as shown in FIG. 9(*a*), the other edge section 112B can freely move forward to the one edge section 112A, but can not move backward, so that engagement between the two edge sections 112A and 112B is not loosened.

To loosen the head band 110 or to separate the two edge sections 112A and 112B from each other, the push buttons 120, 120 protruding from the side walls 118*b* of the hood 118 are pressed inward with fingers. With this operation, tip sections 120*a* of the push buttons 120, 120 contact side sections of the resilient piece 134 with the tip of the resilient piece 134 deformed outward from the insertion space 131. As a result, the engagement claw 114B is disengaged from the engagement groove 114A, so that the head band 110 can be loosened or the one edge section 112A can be separated from the other edge section 112B. In this embodiment, although the hooking sections 116A, 116B are pushed in the horizontal (lateral) direction when two edges of the head band 110 are connected to each other, the push buttons 120, 120 are pushed in the vertical (longitudinal) direction for releasing the engagement between the two edge sections, so that the wearer can easily distinguish the operation for engagement from the operation for disengagement.

With the band described with reference to FIG. 4(*a*) to FIG. 9(*b*), an operation for adjusting a peripheral length of the band is quite easy, and operations for engagement and disengagement can be performed without fail. In addition, as the structure of the head band is extremely simple, the production cost is low and weight of a helmet used together with the head band does not increase.

As the sections operated for engagement are covered with a hood, the engagement is never released carelessly or unexpectedly. Further malfunction due to entry of dusts or other foreign materials into the section operated for engagement never occurs.

The best example of the buckle made from synthetic resin according to the present invention is described below.

Figure 10:
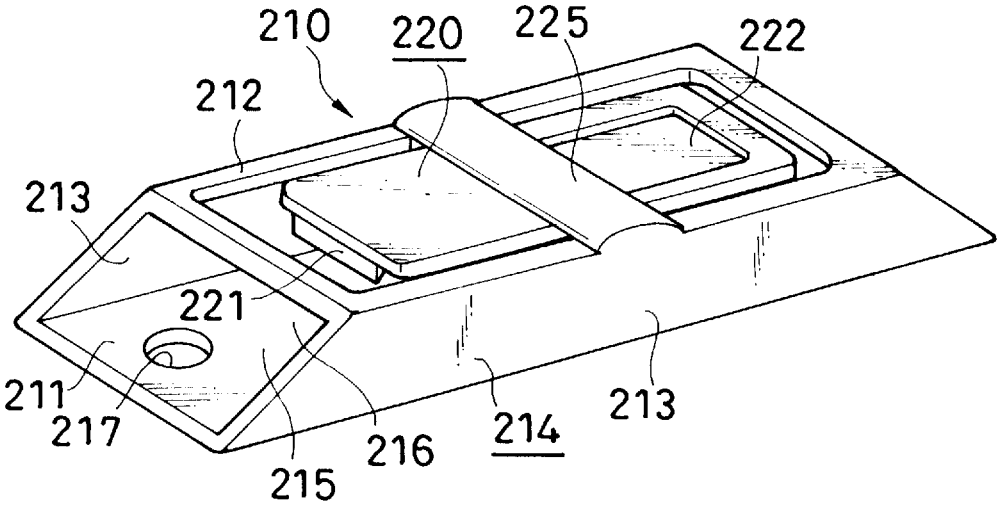
FIG. 10 is a perspective view of a buckle.
Figure 11A:
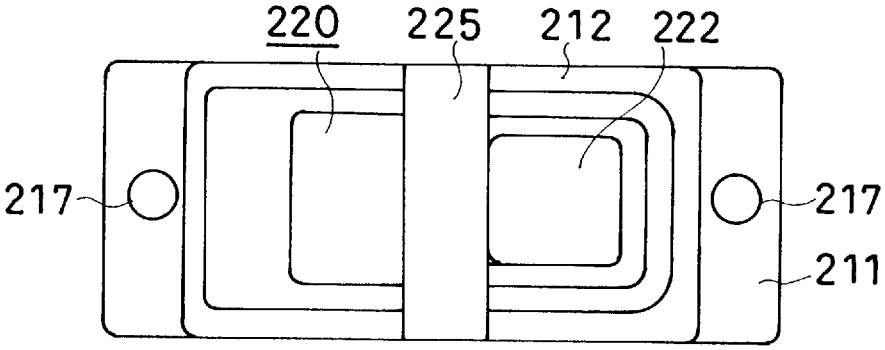
FIG. 11(*a*) is a flat view showing the buckle in FIG. 10, while FIG. 11(*b*) is a cross-sectional view showing the same.
Figure 11B:
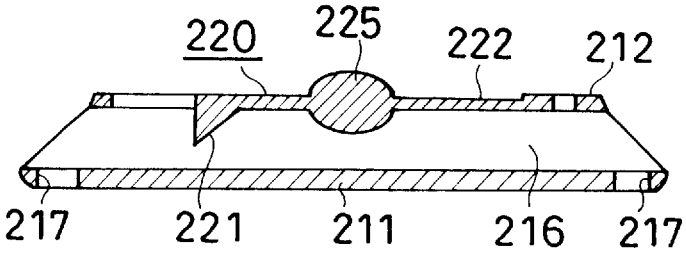

FIG. 10 is a perspective view showing a buckle 210 according to the present invention, and FIG. 11(*a*) is a flat view showing the buckle, while FIG. 11(*b*) is a sectional view showing the same. In these figures, a main body of the buckle 210 comprises a flat and trapezoidal buckle body 214 in turn comprising a bottom plate 211, a ceiling frame 212 opposite to the bottom plate 211, and side plates 213, 213 connecting the bottom plate 211 to the ceiling frame 212. The buckle body 214 has an insertion port 215 in the direction in which the band slides, and the inside is an insertion space 216 having an engagement groove in which the band 230 is inserted.

In this embodiment, a length of the bottom plate 211 in its longitudinal direction (in which the band slides) is larger than that of the ceiling frame 212 in its longitudinal direction, so that a body to be connected to the buckle 210 not shown (namely a head band for a helmet, a band for a bag or the like) can easily be attached to the holes 217, 217 formed on the bottom plate 211, and also insertion of the band can be executed smoothly.

An operation plate 220 with the size smaller than that of the ceiling frame 212 is accommodated in the horizontal position inside of the ceiling frame 212. A protruding hooking claw 221 engageable in an engagement groove on the band 230 is provided on a lower surface of one edge section of the operating plate 220, while a top surface of the other edge section functions as a pressing section 222, and the central section is preferably recessed as compared to the peripheral section. As the operation plate 220 is located at a slightly lower position than the ceiling frame 212, the pressing section 222 is prevented without fail from being depressed carelessly.

A joint shaft 225 is formed at the middle of the operation plate 220 in its longitudinal direction, and this joint shaft 225 is connected to two opposite edges of the ceiling frame 212. In this embodiment, a cross section of the joint shaft 225 is an oval form, but the form may be a different one as circle or others. This joint shaft 225 swingingly supports the operation plate 220, arid may have any form on the condition that it is never broken when swung reciprocally. It is to be noted that the joint shaft 225 is not always required to be jointed to two edges of the ceiling frame 212, and even when it is connected to upper portions of the side plates 213, 213, it can show the same effect as that described below.

The buckle 210 may be formed with any flexible synthetic resin, and especially as the operation plate 220 is swung around the joint shaft 225, it is preferable to fabricate the buckle 210 with such a synthetic resin material as polyacetal, polyoxymethylene, polyamide, or polycarbonate by way of casting. The buckle 210 according to this invention comprises only a few components, and because of its simple structure, it can easily be formed into an integral body with a die.

Operations of the buckle 210 are described with reference to FIG. 12.

Figure 12A:
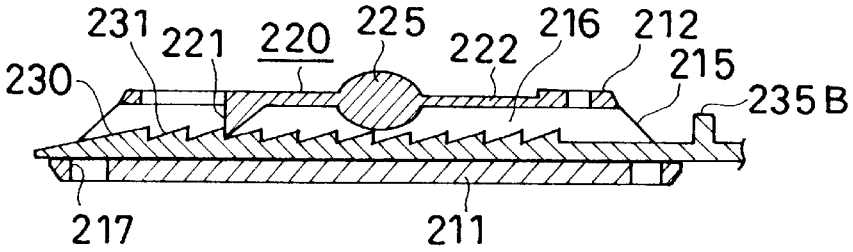
FIGS. 12(*a*) and 12(*b*) are cross-sectional views illustrating operations of the buckle.
Figure 12B:
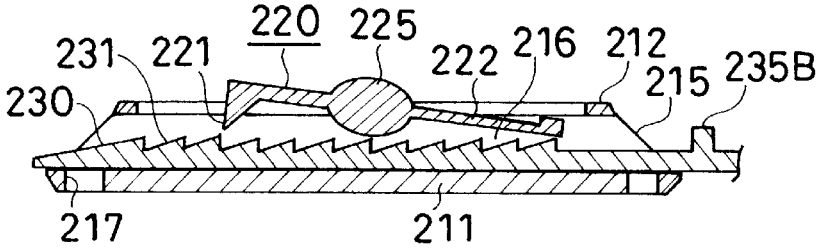

FIG. 12(*a*) shows a state in which the band 230 is inserted into the insertion space 216 of the buckle 210 and the engagement claw 221 of the buckle 210 is engaged in an engagement groove 231 formed on an outer surface of the band 230. The engagement groove 231 comprises a tapered surface having a sawtoothed cross section in the sliding direction, namely a cross section becoming deeper in the direction in which the band 230 advances, and a wall surface erecting in the substantially vertical direction from the deepest position. The reference numeral 235B indicates a hooking protrusion provided on the band 230, which is described hereinafter.

When the band 230 is inserted from the insertion port 215 in the side of the pressing section 222 (in the right side in the figure) and is advanced in the insertion space 216, a top surface of the band 230 contacts the engagement claw 221 of the operation pale 220 and advances raising one edge section of the operation plate 222 (in the side where the engagement claw 221 is formed), thus a position for approach to or separation from the band 230 against the buckle 210 being adjusted. In this state, as shown in FIG. 12(*a*), the engagement claw 221 is engaged and hooked in the engagement groove 231, so that the band 230 can move forward against the buckle 210, but can not move backward.

On the other hand, to move the band 230 backward against the buckle 210 or pull of the band 230 from the buckle 210, the pressed section 222 of the operation plate 220 is slightly depressed with a finger tip. Then, as shown in FIG. 12(*b*), the operation plate 220 turns around the joint shaft 225, so that the engagement claw 221 positioned in the opposite side is raised and the engagement claw 221 is unhooked from the engagement groove 231, and in this state the band 230 can free be slid. When the finger is removed from the depressed section 222, the depressed section 222 restores its original horizontal position because of elasticity of the synthetic resin.

Figure 13:
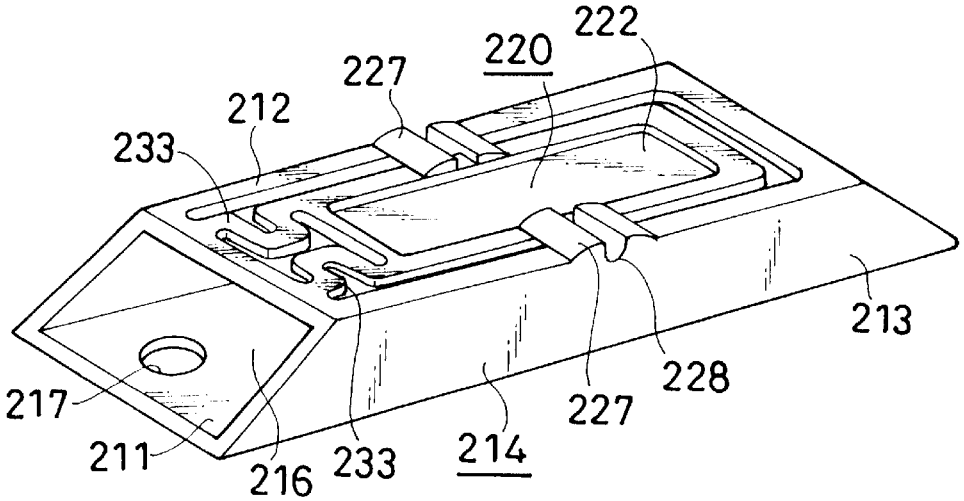
FIG. 13 is a perspective view showing a buckle according to another embodiment of the present invention.

Next another embodiment of the present invention is described with reference to the perspective view shown in FIG. 13. In FIG. 13, the same reference numerals are assigned to the same components as those shown in FIG. 10, and description thereof is omitted herefrom.

In this embodiment, an upper rim section of the operation plate 220 and an upper section of the ceiling frame 212 are jointed to each other at the position of the joint shaft 225 by joint pieces 227, 227, and the operation plate 220 can be swung around the joint pieces 227, 227 as fulcrums. It is to be noted that the reference numeral. 228 indicates a lacked groove formed in the joint pieces 227, 227 in the swinging direction to insure accurate swinging of the operation plate 220.

Figure 14:
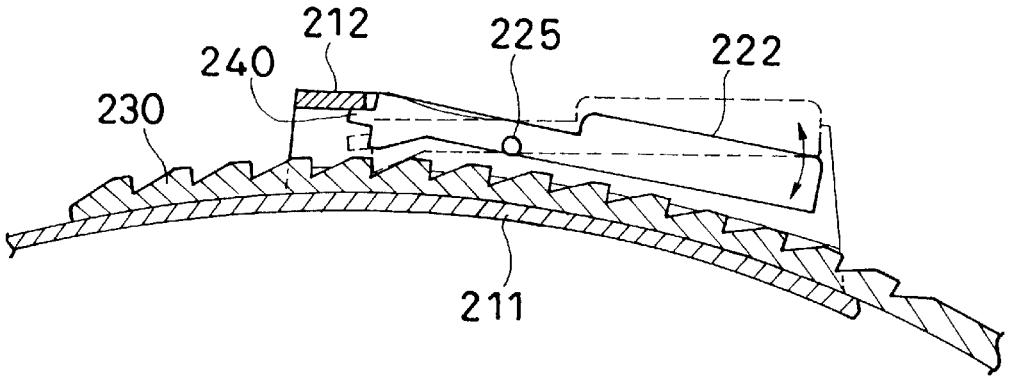
FIG. 14 is a cross-sectional view showing the buckle in FIG. 13.

In this embodiment, one edge section of the operation plate 220 (in the side where the engagement claw 221 is provided) is jointed to the opposite ceiling frame 212. This joint is realized with joint members 233, 233 each extending from a corner of the operation plate 220, and after the pressed section 222 is depressed and then the finger tip is removed from the pressed section, the operation plate 220 can easily restore its original horizontal position. Therefore, any form such as a waved plate other than that described above may be employed as a form of the joint member 233. In other words, the joint member 233 functions as a damper against swinging operations of the operation plate 220. Further, a side rim section of the operation plate 220 other than the one edge section thereof may be jointed to the ceiling frame 212 on the condition that the operation plate 220 and the ceiling frame 212 are positioned in the opposite side of the depressed section 222 around the joint shaft 225 (or a joint piece 227). For that purpose, it is desirable to locate a stopper 240 at the one edge section of the operation plate 220 so that the one edge section is contacted to and raised by the ceiling frame 212 to an unnecessarily high position. In the embodiment shown in FIG. 14, the bottom plate 211 is formed into a curved surface along the head section, leg section, body section or other section on which the bottom place 211 is to be placed.

Figure 15A:
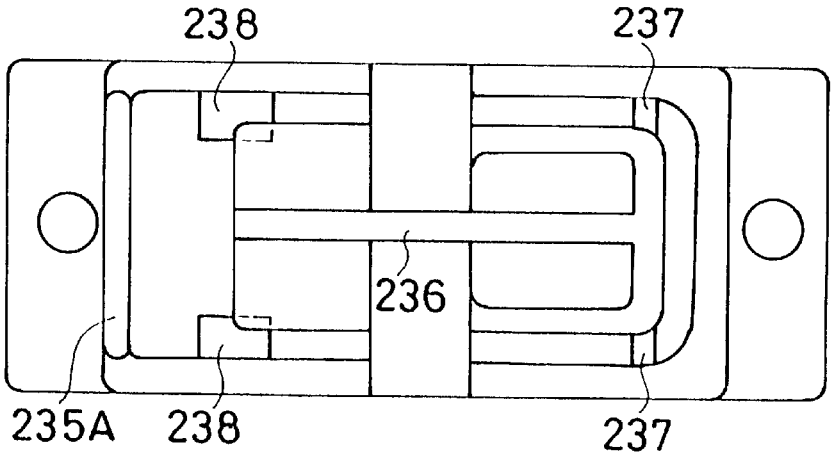
FIG. 15(*a*) is a flat view showing the buckle in FIG. 11 according to still another embodiment of the present invention, while FIG. 15(*b*) is a cross-sectional view showing the same.
Figure 15B:
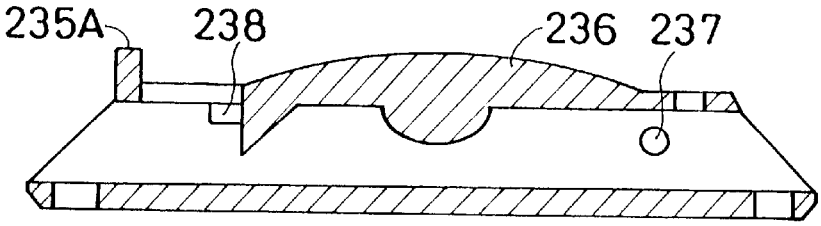
Figure 15B:
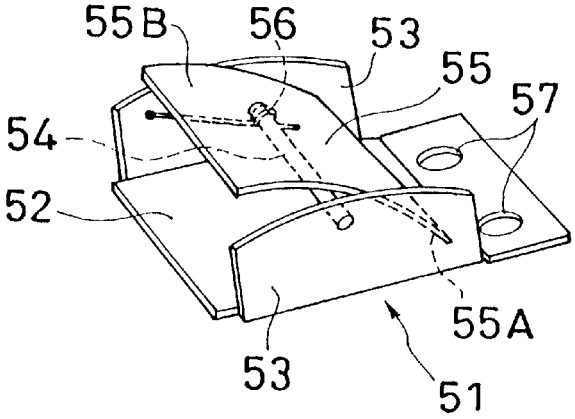

Next a variant of the buckle 210 according to still another embodiment of the present invention is described with reference to FIGS. 15(*a*) and 15(*b*).

In this embodiment, a hooking protrusion 235A is provided on the ceiling frame 212 in the protruding state. By simultaneously hooking finger tips on the hooking protrusion 235A and the hooking protrusion 235B provided on an outer surface of the band 230 as shown in FIG. 12(*a*), the band 230 can be pulled closer to the buckle 210 with one hand. Therefore, the hooking protrusions 235A and 235B are required only to have the size enough for a finger tip to be hooked thereon, and there is no restriction over the form.

A reinforcing rib 236 is provided at a central position of the top surface of the operation plate 220 in the longitudinal direction to insure swinging operations of the operation plate 220. The rib 236 may be provided at a position other than the central position of the top surface of the operation plate 220, for instance, along the upper rim of the operation plate 220 in the longitudinal direction, or on a rear (bottom) surface of the operation plate 220.

Stoppers 237 for preventing the other edge section (in the side where the pressed section 222 is provided) from being depressed to an unnecessarily low level are provided in the insertion space 216 in the buckle body 214. In this embodiment, the stoppers 237 are provided under the edge section and protrude from each of the two side plates 213, 213.

Further provided inside the insertion space 216 are band holders 238, 238 for preventing the band 230 from being raised. If the band 230 is raised, the engagement groove 231 of the band 230 is raised when the engagement claw 221 is disengaged from the engagement groove 231, which makes it impossible to disengage the engagement claw 221 from the engagement groove 231. In this embodiment, the band holders 238 are provided just below the engagement claw 221 in the protruding state from the two side plates 213, 213.

The number of components in the buckle according to the present invention is small, and the buckle is made from synthetic resin, so that the weight is small and the production cost is low. Further, the engagement claw is directly operated by the wearer, so that the wearer can accurately engage or disengage the buckle. In addition, as the operation plate is surrounded by the ceiling frame, the buckle is never unlocked carelessly or unexpectedly. Further, the operation plate is provided in parallel to the bottom plate, so that a form of the buckle is very flat and compact. Especially, when this buckle is used for a head band for a helmet, even if the buckle is present at a rear section of the wearer's head, the band size can easily be adjusted by unlocking the buckle. Because of the features as described above, the buckle of a head band for a helmet according to the present invention is best suited to use in various works including construction works, civil engineering works, or when the wearer is driving a car or sporting.

The buckle according to the present invention is fabricated by casting, and as the die used for casting has a simple structure, cost of the die is low, and fabrication of the buckle is very easy.

The buckle having a joint shaft jointing the two intermediate points of the side plates insure swinging operations of the operation plate provided in the horizontal position, and in addition the buckle is structurally very solid and can endure reciprocal operations of the operation plate for a long time.

The buckle, in which a section near one edge section of the operation plate is jointed. to at least one edge of the ceiling frame opposite to the operation pale, enables the operation plate to easily restore the original position, which further insures accurate operations for engagement or disengagement with improvement reliability.

What is claimed is:

1. A band comprising:

one edge section having engagement grooves, and the other edge section having an engagement claw, said band being set into a circular form by sliding the two edge sections over each other to adjust the length and engaging one of the engagement grooves with the engagement claw at a desired position, wherein a resilient piece having the engagement claw is provided substantially in parallel to the other edge section, the one edge section can move freely to the other edge section and can not move backward when the engagement claw is engaged in one of the engagement grooves, the engagement claw can be disengaged from the one of the engagement grooves by pressing the resilient piece, the resilient piece is made from a material harder than a material used for the two edge sections, and the resilient piece is covered with a hood expanding to an outer periphery side at the other edge section of the band.

2. The band according to claim 1, wherein a pair of hooking sections, making it possible to pull the two edge sections closer to each other with finger tips of one hand, is provided at outer surfaces of the two edge sections.

3. The band according to claim 1, further comprising band holders provided along upper and lower rims of an outer surface of the other edge section.

4. A buckle made from synthetic resin and having a buckle body comprising a bottom plate, a ceiling frame opposite to the bottom plate and two side plates connecting the bottom plate to the ceiling frame, and including a space for insertion of a band with engagement grooves, and an operation plate provided inside the ceiling frame in a horizontal position and having an engagement claw engageable in the engagement grooves on a bottom surface of one edge section thereof and a top surface of the other edge section used as a pressing section, wherein said operation plate is jointed to opposite two edges of the ceiling frame at intermediate points between the engagement claw and the pressing section so that the operation plate can freely swing around the intermediate points as a fulcrum, and a portion near the other edge section of said operation plate is jointed to at least one edge of the ceiling frame opposite to the operation plate.

5. The synthetic resin buckle according claim 4, wherein said buckle is fabricated by casting.

6. The synthetic resin buckle according to claim 4, wherein said ceiling frame and said operation plate are jointed to each other with a joint shaft connecting the intermediate points.

7. The synthetic resin buckle according to claim 4, wherein a pair of hooking protrusions, making it possible to pull the band closer to the buckle body with finger tips of one hand, is provided on an outer surface of the band as well as on the ceiling frame.

* * * * *